US006134846A

United States Patent [19]

Lamb

[11] Patent Number: 6,134,846

[45] Date of Patent: Oct. 24, 2000

[54] MODULAR SLATWALL SYSTEM

[76] Inventor: Charles Lamb, Rte. 1, Box 1, Ontario, Wis. 54651

[21] Appl. No.: 09/190,035

[22] Filed: Nov. 11, 1998

Related U.S. Application Data

[60] Provisional application No. 60/065,669, Nov. 18, 1997.

[51] Int. Cl.[7] ..... E04C 1/10

[52] U.S. Cl. ..... 52/36.5; 52/588.1; 211/94.01

[58] Field of Search ..... 52/36.1–36.6, 52/27, 588.1, 592.1; 211/87.01, 94.01, 94.02, 189, 103

[56] References Cited

U.S. PATENT DOCUMENTS

| | | | |
|---|---|---|---|
| 4,694,965 | 9/1987 | Parnell | 52/36.5 X |
| 4,809,479 | 3/1989 | Tierno et al. | 52/36.5 X |
| 4,961,295 | 10/1990 | Kosch, Sr. et al. | 52/36.5 |
| 5,228,579 | 7/1993 | Kaufman | 211/94.01 |
| 5,413,912 | 5/1995 | Alves | 52/36.5 |
| 5,622,010 | 4/1997 | Weber | 52/36.4 |
| 5,819,490 | 10/1998 | Current | 52/588.1 |
| 5,899,344 | 5/1999 | Current et al. | 211/94.01 |
| 5,941,026 | 8/1999 | Eisenreich et al. | 52/36.5 |
| 5,983,574 | 11/1999 | Holtztranger | 52/36.5 |

*Primary Examiner*—Richard Chilcot

*Attorney, Agent, or Firm*—Craig A. Fieschko, Esq.; DeWitt Ross & Stevens S.C.

[57] ABSTRACT

A slatwall system having a central, female, and male channels. The central channel includes top and bottom slots, as does the female channel, whereas the male channel includes a top slot and a bottom tongue. The channels may be arrayed on a wall such that the female channel bottom slot and the central channel top slot face each other, and so that the central channel bottom slot and the male channel top slot face each other. The facing slots of these channels thereby define grooves where hanging implements may be inserted. Further, the female and male channels are sized and configured such that when a male channel bottom tongue is inserted within a female channel top slot, the combined female and male channels have substantially the same size and configuration as the central channel; in other words, the male channel top slot resembles the central channel top slot and the female channel bottom slot resembles the central channel bottom slot. This arrangement allows multiple central channels (or combined male and female channels) to be stacked atop each other, and/or stacked below female channels and above male channels, to define a slatwall array having numerous grooves for hanging implements. Terminal members for vertically terminating the top sides and bottom sides of a slatwall array are also shown and described, as are spacer members for allowing spacing of the hanging grooves at desired vertical locations.

19 Claims, 4 Drawing Sheets

MODULAR SLATWALL SYSTEM

CROSS-REFERENCE TO RELATED APPLICATIONS

This application claims priority under 35 USC § 119(e) to U.S. Provisional Patent Application 60/065,669 filed Nov. 18, 1997, the entirety of which is incorporated by reference herein.

FIELD OF THE INVENTION

This invention relates generally to the field of wall display systems, and more specifically to the field of slatwall display systems wherein grooves are provided in walls to accommodate hanging implements.

BACKGROUND OF THE INVENTION

Slatwall systems are commonly used in retail environments to display goods on walls. These systems generally use metal rails which bear grooves and which are affixed to walls, or which define grooves adjacent to the walls whereupon the rails are affixed. The grooves allow hanging implements such as hooks, cantilevered arms, etc. to be hung on the rails. Goods may then be hung on these hanging implements, or may instead be hung directly on the slatwall if the goods have built-in hanging implements and/or if they have the proper size and configuration. Common slatwall systems tend to suffer from several deficiencies.

First, they tend to be somewhat aesthetically unattractive because they visibly stand out on walls, thereby drawing attention to the rails, etc. rather than to the goods themselves. This is disadvantageous since a prime objective of the display is to draw attention to the goods and present them in an aesthetically pleasant environment, thereby enhancing the probability of a sale. The prior slatwall systems known to the inventor are quite ugly, and have an appearance which brings to mind industrial hardware rather than an attractive means of display which a consumer would accept for use in one's own home.

Second, prior slatwall systems can be somewhat weak, making it difficult to hang larger goods (e.g., guitars) on the slatwall without risking failure and the possibility of the goods falling to the floor. This is particularly true where goods are hung on cantilevered arms inserted within the slatwall's slots, since such cantilevered arms act as levers on the slatwall and exert high stresses. The disadvantage of weakness unfortunately tends to work synergistically with the disadvantage of unattractiveness noted above: since larger and heavier goods are typically more expensive, they require a more attractive display system to enhance sales, but at the same time any slatwall used to hang such goods must be scaled up in size and therefore tends to be exceptionally ugly.

Third, prior slatwall systems are not very versatile in that they do not allow flexibility in hanging arrangements. The most commonly used slatwall known to the inventor is provided in four foot by eight foot sections, which makes it difficult to accommodate on surfaces having unusual shapes or sizes. Further, on these slatwall sheets, the hanging grooves are provided in a predetermined array which cannot be varied by users; thus, users are constrained to hang items in the slatwall in only certain predetermined patterns.

SUMMARY OF THE INVENTION

The invention, which is defined by the claims set out at the end of this disclosure, is directed to a slatwall system which alleviates the aforementioned problems and which provides a new slatwall system for use in displaying items in retail and home environments. A brief summary of the slatwall system will now be provided, with reference being made to numbered elements of the accompanying drawings to assist the reader's understanding.

In its most preferred form (as illustrated in FIGS. 1 and 2), the slatwall system includes several channels, more specifically central (100), female (200), and male (300) channels, all of which each include opposing front and rear sides and opposing top and bottom sides. The central (100) and female (200) channels bear top and bottom slots on their respective top and bottom sides, whereas the male channel (300) has a top slot at its top side and a bottom tongue protruding from its bottom side. Further, the male channel top side has a configuration substantially identical to the central channel top side, and similarly the female channel bottom side has a configuration substantially identical to the central channel bottom side. When the female channel bottom side is placed adjacent the central channel top side (with the central and female channels having their rear sides situated generally coplanarly), a frontwardly-opening first groove (130) is defined by the female channel bottom slot and the central channel top slot. Similarly, when the male channel top side is placed adjacent the central channel bottom side (with the central and male channels having their rear sides situated generally coplanarly), a frontwardly-opening second groove (140) is defined by the male channel top slot and the central channel bottom slot. These first and second grooves (130/140), which preferably expand in the rearward direction so that they have narrow mouths opening onto broader interiors, may accommodate hanging implements (e.g., 1000). The central channel bears a valley (122) extending along its front side which is preferably dimensioned similarly to the mouths of the grooves (130/140). As will be explained at greater length below, this valley (122) (as well as other valleys to be described later) tends to effectively "camouflage" the grooves (130/140) by making the slatwall array formed by the channels (100/200/300) appear to have a number of such valleys. As a result, the slatwall array does not have the appearance of slatwall, and rather appears to be a decorative wall surface having a plurality of valleys.

In this arrangement, the bottom tongue of the male channel (300) is adapted to complementarily fit within the top slot of the female channel (200), with the rear sides of the male and female channels forming a substantially continuous and generally coplanar surface. When this is done, the female and male channels (200/300) are sized and configured substantially identically to the central channel (100) when taken in combination, even to the extent that the female and male channels (200/300) define a valley between their front sides resembling the central channel valley (122). This feature may be observed in FIG. 2, wherein the dashed line 190 within the central channel 100 illustrates the boundaries of combined male and female channels (200/300). Thus, if desired, the combined female and male channels (200/300) may be used in place of a central channel (100).

By use of the foregoing arrangement, one may stack several central channels (100) atop each other, or stack one or more central channels (100) between female (200) and male (300) channels (as in FIGS. 1 and 2), to provide a slatwall array wherein a number of grooves (130, 140) are provided for hanging implements. The utility of the slatwall system is then further enhanced by including some or all of the following additional components:

First, the slatwall system may include male (400) and/or female (500) terminal members for terminating the vertical ends of slatwall arrays, both of which include opposing front and rear sides and opposing top and bottom sides. The male terminal member (400) includes a protruding bottom tongue which is sized and configured substantially identically to the bottom tongue of the male channel (300), and which is therefore adapted to complementarily fit within the top slot of the female channel. The female terminal member (500) includes a top slot which is sized and configured substantially identically to the top slot of the female channel (200). When the male terminal member bottom tongue is inserted within the female channel top slot, a valley (422) is defined between the front sides of the male terminal member (400) and the female channel (200) which is similar in configuration to the central channel valley (122). Similarly, when the male channel bottom tongue is inserted within the female terminal member top slot, a valley (522) is defined between the front sides of the female terminal member (500) and the male channel (300) which is similar in configuration to the central channel valley (122). As with the central channel valley (122), these valleys (422, 522) are preferably sized with openings similar to those of the grooves (130, 140). With reference to FIG. 2, it can be seen that the similar appearance of the valleys and grooves tends to make it difficult to distinguish the grooves from the valleys, and thereby makes the slatwall array appear as a wall having only decorative valleys.

Second, concave channel inserts (600) formed of strong thin material may be provided, wherein these channel inserts are adapted to complementarily fit about substantially the entireties of the surfaces of the grooves (130, 140). The channel inserts (600) thereby serve to strengthen the interiors of the grooves (130, 140) and protect them from damage from weighted hanging implements. Additionally, the channel inserts (600) serve to better distribute the weight of hung objects over the adjoining channels defining the grooves (i.e., channels 100 and 200 for groove 130, and channels 100 and 300 for groove 140) to provide greater support for hung objects. Since the channels (100/200/300) adjacent the channel inserts (600) are then interconnected with adjacent channels/terminal members in the slatwall array, the weight borne by the channel inserts (600) within the grooves (130/140) is effectively transferred to the entire slatwall array, thereby providing higher weight-bearing capacity than prior slatwall systems known to the inventor.

Third, with reference to FIGS. 3 and 4, the slatwall system may include spacer members (700) having top slots sized and configured substantially identically to the female channel top slots, and bottom tongues sized and configured substantially identically to the male channel bottom tongues. The spacer members may therefore be inserted between the various components noted above to allow the grooves (130, 140) be spaced at desired distances from each other.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
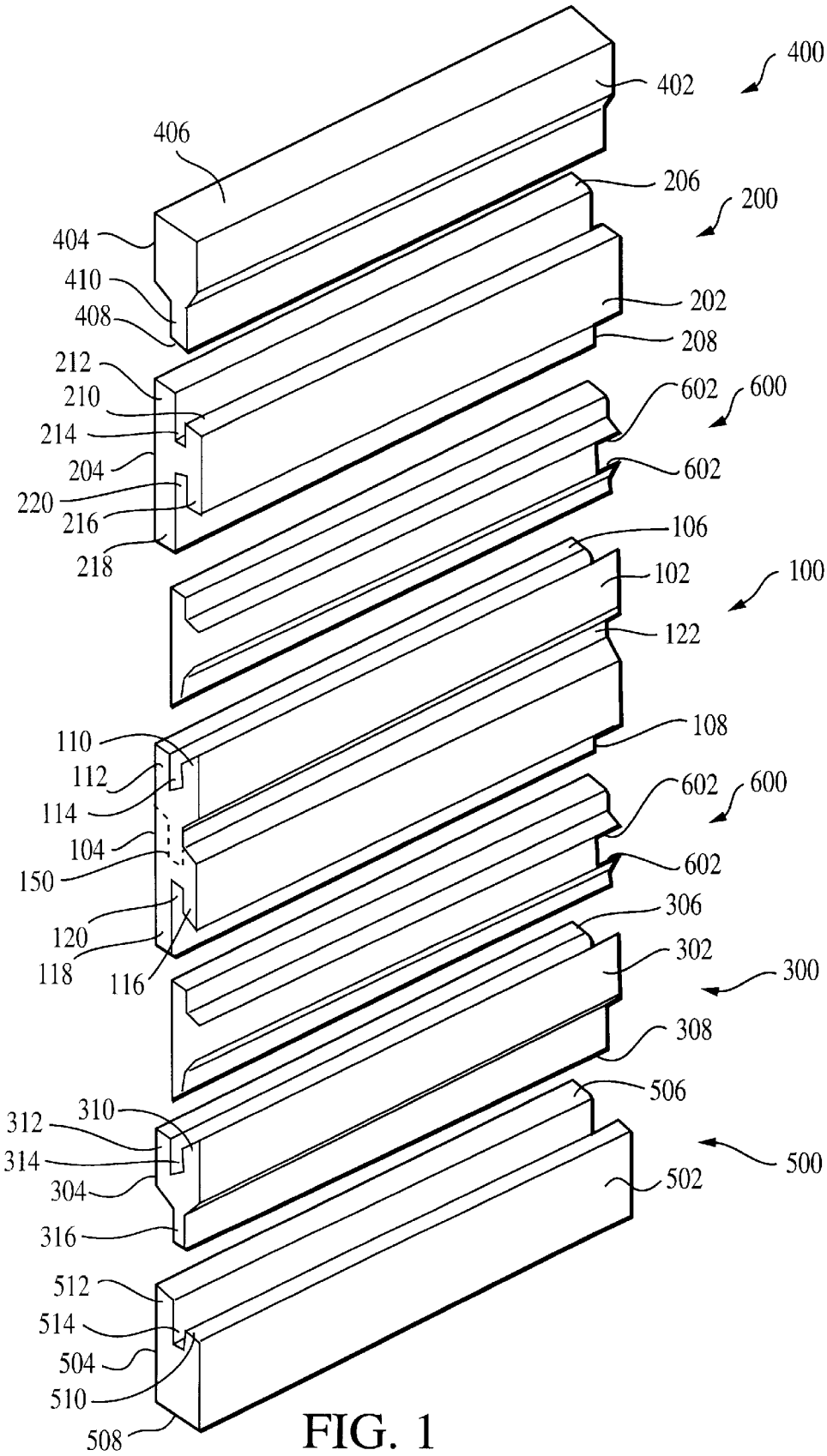
FIG. 1 is a front exploded perspective view of a basic embodiment of the slatwall system, shown with a central channel 100, a female channel 200, a male channel 300, a male terminal member 400, a female terminal member 500, and channel inserts 600.
Figure 2:
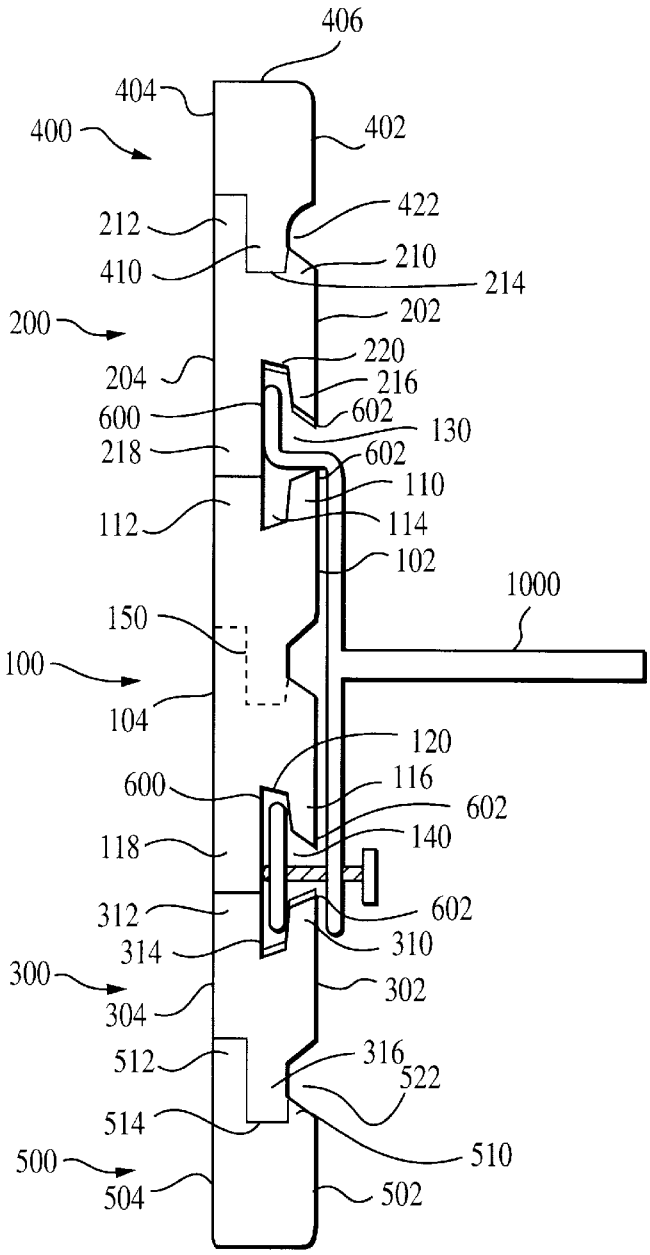
FIG. 2 is a side elevational view of the assembled slatwall system of FIG. 1.

A basic embodiment of the slatwall system is illustrated in FIGS. 1 and 2. The primary components of this system are a central channel 100, a female channel 200, and a male channel 300, each of which will be discussed in turn below.

The central channel 100 includes a front side 102, an opposing rear side 104, a top side 106, and an opposing bottom side 108. The top side 106 includes a top front lip 110 adjacent the front side 102 and a top rear lip 112 adjacent the rear side 104, thereby defining a top slot 114 therebetween. Similarly, the bottom side 108 includes a bottom front lip 116 adjacent the front side 102, a bottom rear lip 118 adjacent the rear side 104, and a bottom slot 120 defined therebetween. Preferably, at least one of the rear lips 112 or 118 has a greater length than its respective front lip 110 or 116, thereby providing easier attachment of the central channel 100 to a wall by providing an unobstructed surface through which fasteners can be rearwardly driven to affix the central channel 100 to a wall. In the version of the slatwall system illustrated in FIG. 1, the bottom rear lip 118 has greater length than the bottom front lip 116, whereas the top rear lip 112 has approximately the same length as the top front lip 110. For purposes that will be described below, the front side 102 of the central channel 100 preferably bears a valley 122.

The female channel 200 includes a front side 202, an opposing rear side 204, a top side 206, and an opposing bottom side 208. The top side 206 includes a top front lip 210 adjacent the front side 202 and a top rear lip 212 adjacent the rear side 204, thereby defining a top slot 214 therebetween. Similarly, the bottom side 208 includes a bottom front lip 216 adjacent the front side 202 and a bottom rear lip 218 adjacent the rear side 204, with a bottom slot 220 defined therebetween. Again, at least one of the rear lips 212 and 218 preferably has greater length than its corresponding front lip 210 and 216 so as to better provide an unobstructed surface through which fasteners can be rearwardly driven to affix the female channel 200 to a wall. In this case, both of the rear lips 212 and 218 are longer than their corresponding front lips 210 and 216.

The male channel 300 includes a front side 302, an opposing rear side 304, a top side 306, and an opposing bottom side 308. The top side 306 includes a top front lip 310 adjacent the front side 302, a top rear lip 312 adjacent the rear side 304, and a top slot 314 defined therebetween. At the bottom side 308, a downwardly-protruding bottom tongue 316 is provided, with this bottom tongue 316 resting within generally the same planes as the male channel top slot 314.

As shown in FIG. 2, when the system is placed in use, the bottom side 208 of the female channel 200 (more specifically, the bottom rear lip 218) is preferably situated in abutment with the top side 106 of the central channel 100 (more specifically, with its top rear lip 112). Because the length of the bottom rear lip 218 is greater than that of the bottom front lip 216, a frontwardly-opening first groove 130 is defined between the front sides 102 and 202 of the central and female channels 100 and 200. The first groove 130 is partially defined by the female channel bottom slot 220 and the central channel top slot 114. Similarly, when the system is placed in use, the central channel bottom side 108 (more specifically, its bottom rear lip 118) is preferably situated in abutment with the male channel top side 306 (more specifically, with its top rear lip 312). Since the length of the central channel bottom rear lip 118 is greater than that of the central channel bottom front lip 116, a frontwardly-opening second groove 140 is defined between the front sides 102 and 302 of the central and male channels 100 and 300. The second groove 140 is thereby partially defined by the bottom slot 120 of the central channel 100 and the top slot 314 of the male channel 300. The first and second grooves 130 and 140 may accommodate hanging implements from which goods are hung (as illustrated by the exemplary hanging implement 1000 shown in FIG. 2), or can accommodate the goods themselves if they are appropriately configured.

Preferably, the female and male channels 200 and 300 are sized and configured in such a fashion that when the male channel bottom tongue 316 is inserted within the female channel top slot 214, it is complementarily received therein with a substantial portion of the female channel top side 206 abutting a corresponding portion of the male channel bottom side 308. When the male channel bottom tongue 316 is inserted within the female channel top slot 214 in this manner, the combined female and male channels 200 and 300 have two unique characteristics. First, the space between the female channel top front lip 210 and the male channel front side 302 defines a valley having substantially the same configuration as the valley 122 in the central channel 100. Second, the female and male channels 200 and 300 are otherwise sized and configured substantially identically to the central channel 100. This arrangement is best visualized with reference to FIGS. 1 and 2, wherein the dashed line 150 shown on the central channel 100 illustrates the adjoining borders of male and female channels 200 and 300 when combined in the aforementioned fashion. In this manner, one could simply provide the female and male channels 200 and 300 in lieu of a central channel 100, and could construct central channels 100 from the female and male channels 200 and 300 as desired.

As noted above, the first and second grooves 130 and 140 situated between the central, female and male channels 100, 200, and 300 are intended to accommodate hanging implements such as the cantilever arm 1000 illustrated in FIG. 2. In order to better accommodate this and other hanging implements, the grooves 130 and 140 preferably expand in cross-sectional size in the rearward direction so as to better accommodate the hanging implements, with the frontward contraction in the areas of the grooves 130 and 140 helping to retain the hanging implements therein.

Further components of the basic slatwall system are also illustrated in FIGS. 1 and 2, and include a male terminal member 400 and a female terminal member 500. The male terminal member 400 includes a front side 402, an opposing rear side 404, a top side 406, and an opposing bottom side 408. The top side 406 is preferably defined by a continuous substantially planar surface extending between the front and rear sides 402 and 404, since this side is intended to rest at one of the vertical ends of an array of slatwall. However, surfaces having other configurations may be used instead if a different functional or decorative effect is desired. The bottom side 408 includes a protruding bottom tongue 410 extending therefrom, with this bottom tongue 410 being configured substantially identically to the bottom tongue 316 of the male channel 300. As a result, the bottom tongue 410 may be accommodated within the slots of other slatwall components, e.g., the top slot 214 of the female channel 200, in the same manner as the male channel bottom tongue 316. Similarly to the case when the male channel bottom tongue 316 is inserted within the female channel top slot 214, when the male terminal member bottom tongue 410 is inserted within the female channel top slot 214, a substantial portion of the male terminal member bottom side 408 complementarily abuts a corresponding portion of the female channel top side 206, and a valley 422 is defined between the front sides 202 and 402 which has substantially the same configuration as the central channel valley 122.

The female terminal member 500 includes a front side 502, an opposing rear side 504, a top side 506, and an opposing bottom side 508. As with the male terminal member top side 406, the female terminal member bottom side 508 preferably provides a continuous substantially planar surface between the front and rear sides 502 and 504 because it is to rest at an end of a vertical array of slatwall. However, it is noted that surfaces having other configurations may be used instead if such is desired for a different decorative or functional effect. The female terminal member top side 506 includes a top front lip 510 adjacent the front side 502, a top rear lip 512 adjacent the rear side 504, and a top slot 514 defined therebetween. Similarly to the manner in which the male terminal member bottom tongue 410 may be complimentarily received within the female channel top slot 214, the female terminal member top slot 514 is configured to complimentarily receive the male channel bottom tongue 316. When this occurs, a valley 522 is defined between the male channel front side 302 and the female terminal member front side 502, and this valley 522 has substantially the same configuration as the valley 122 in the central channel 100.

To summarize from the aforementioned description, (1) the male channel bottom tongue 316 and the male terminal member bottom tongue 416 are sized and configured substantially identically, so that they may be complimentarily received within the female channel top slot 514 and/or female terminal member top slot 514 (as best illustrated in FIG. 2); and (2) the female channel top slot 214 and female terminal member top slot 514 are also sized and configured substantially identically so that they may complimentarily receive the male channel bottom tongue 316 and/or the male terminal member bottom tongue 416.

With primary reference being made to FIG. 1, two channel inserts 600 having identical configuration are shown. These channel inserts 600 are concave between their opposing edges 602 and are sized and configured so as to be received within the first and second grooves 130 and 140 to cover at least a substantial portion of the surfaces of these grooves, i.e., they cover the surfaces of the female channel bottom slot 220 and the central channel top slot 114, and also the surfaces of the central channel bottom slot 120 and the male channel top slot 314. These channel inserts 600, which are preferably made of thin and durable material such as metal or plastic, need only be provided when the channels 100, 200 and 300 are made of materials that could be subject to breakage or other damage from hanging implements resting within the first and second grooves 130 and 140. The channels 600 serve to reinforce the surfaces of the first and second grooves 130 and 140 and also to distribute the weight of hung objects over multiple channels 100, 200, and 300; for example, the channel insert 600 between the central and female channels 100 and 200 will distribute the weight of a hung object over both of these channels, and the channel insert 600 between the central and male channels 100 and 300 will distribute the weight of a hung object over both of these channels. Since the channel inserts 600 are not directly affixed to the wall—as can be best seen from FIG. 2—the weight of objects hung in a channel insert 600 is effectively transferred to its adjoining channels. It is then notable that since these channels/terminal members are in turn connected to adjoining channels and/or terminal members in interlocking fashion, the weight of a hung object is effectively supported by the entire slatwall array. Since the slatwall array will generally be attached to the wall at multiple points, the slatwall system is exceedingly strong and may support significantly higher weights than prior slatwall known to the inventor.

It is noted that the front lips 110, 116, 216 and 310 are preferably beveled so that the portion of the first groove 130 resting between the female channel bottom front lip 216 and the central channel top front lip 110, and the portion of the second groove 140 resting between the central channel bottom front lip 116 and the male channel top front lip 310, expand as they extend rearwardly (as best seen in FIG. 2). As a result, the edges 602 of the channel inserts 600 within the first and second grooves 130 and 140 tend to be obscured from vision by the front sides 102, 202 and 302 of the channels 100, 200 and 300, and therefore users/observers will barely even note the presence of the channels 600. Further, because of the valleys 122, 422, and 522 defined in the central channel 100, between the male terminal member 400/female channel 200, and between the male channel 300/female terminal member 500, the openings of the first and second grooves 130 and 140 tend to appear substantially similar to the valleys 122, 422, and 522. As a result, the slatwall does not appear to be slatwall at all, and rather appears to be a decorative paneling surface bearing several valleys therein. In other words, the configuration of the various channels and terminal members and their associated grooves 122, 422, and 522 serve to "camouflage" the first and second grooves 130 and 140.

It is noted that the channels 100, 200 and 300 and the terminal members 400 and 500 are preferably formed of wood milled into the shapes shown in the Figures and described above, or of plastic or composite substances which may be milled or extruded into the aforementioned shapes. Use of wood, particularly hardwood such as oak or maple, make the slatwall system far more aesthetically pleasant in appearance than prior slatwall systems known to the inventor, which tend to have the appearance that they were designed for industrial or institutional use. It is also noted that the features of the channels 100, 200, and 300 described above, as well as the features of the male terminal member 400, female terminal member 500, and channel insert 600 described above, are preferably provided along the entireties of the lengths of these structures (which may be formed in any desired length).

Of course, it should be understood from the discussion above that the terminal members 400 and 500 may be removed from the arrangement shown in FIG. 2 and replaced with further channels 100, 200, and 300 to extend the slatwall array in the vertical direction. The terminal members 400 and 500 can then be installed when it is desired to terminate the slatwall.

Figure 4:
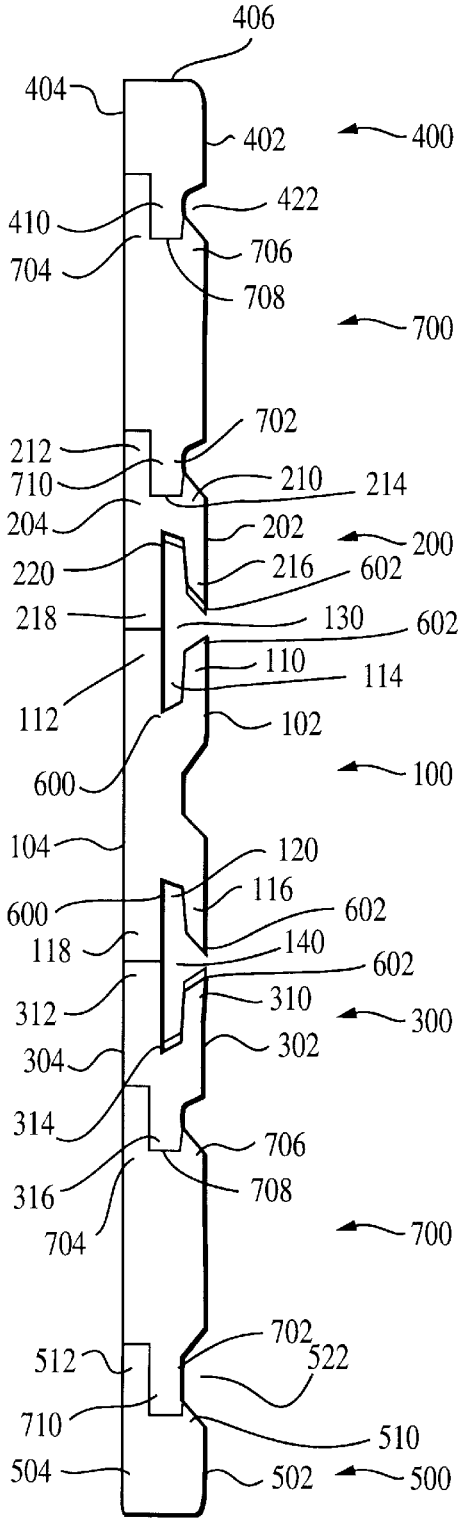
FIG. 4 is a side elevational view of the assembled slatwall system of FIG. 3.
Figure 3:
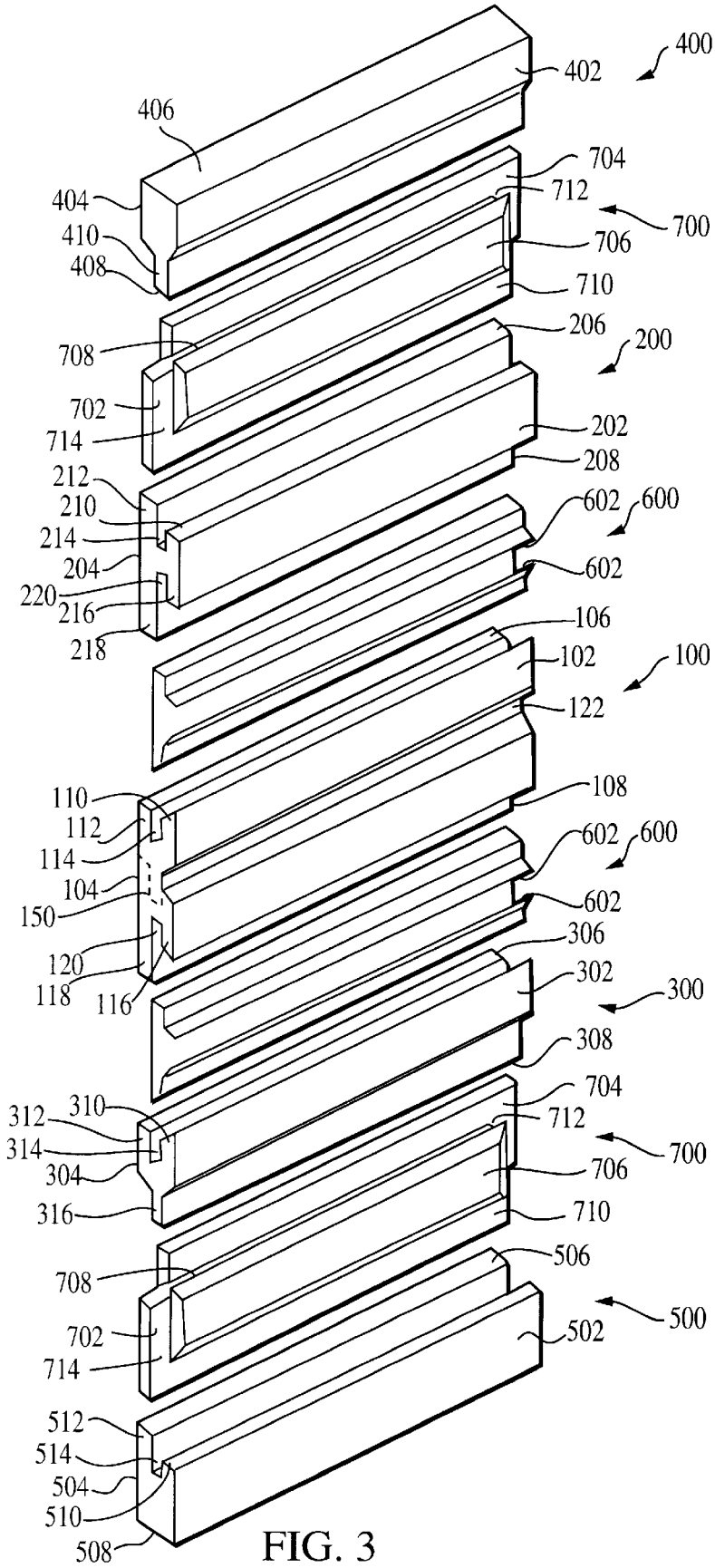
FIG. 3 is a front exploded perspective view of the slatwall system of FIG. 1 shown with spacer members 700 included.

FIGS. 3 and 4 then illustrate another preferred version of the slatwall system wherein spacer members 700 are incorporated. These spacer members 700 allow the various aforementioned components of the slatwall system to be spaced apart from each other as desired so as to provide the grooves 130 and 140 at desired distances from each other. As illustrated in FIGS. 3 and 4, the preferred spacer members 700 for use in the invention are WOODBRICKS® panels, which have been sold by Lamb Hardwood Lumber (Ontario, Wis., U.S.A.) for at least the last year. The WOODBRICKS® spacer members 700 are unique in that a user may fit a number of them on a wall in adjacent relation to provide a continuous surface, and the wall surface so produced has a simulated brick appearance with protruding portions similar to the faces of bricks and recessed portions mimicking the mortared seams between adjacent bricks. The WOODBRICKS® spacer members 700 also connect to each other in interlocking fashion so that the surface produced by the spacer members 700 has extremely high durability. With particular reference to FIG. 4, the WOODBRICKS® spacer members 700 can effectively be regarded as being formed of two rectangular and substantially flat upper and lower slabs 702 and 704 of substantially equal size and shape, with these slabs 702 and 704 being stacked in coplanar fashion with their edges offset. A face plate 706, which is also rectangular and substantially flat but which has smaller area than the upper and lower slabs 702 and 704, is affixed to the upper slab 702 to overlap both of the upper and lower slabs 702 and 704 in such a manner that it is substantially equally spaced from the edges of their major rectangular surfaces. Owing to the offset between the upper slab 702 and the lower slab 704, a top slot 708 is defined between the lower slab 704 and the face plate 706, and a bottom tongue 710 is defined by the upper slab 702 between the lower slab 704 and the face plate 706. Additionally, a side slot 712 is defined at one end of the WOODBRICKS® spacer members 700 between the lower slab 704 and the face plate 706, and a side tongue 714 is defined by the upper slab 702 at the opposite side of the WOODBRICKS® spacer members 700 between the lower slab 704 and the face plate 706. The WOODBRICKS® spacer members 700 may therefore be fit on a wall in interlocking fashion with their bottom tongues 710 resting within the top slots 708 of lower WOODBRICKS® spacer members 700 and with their side tongues 714 resting within the side slots 712 of adjacent WOODBRICKS® spacer members 700. At the same time, each WOODBRICKS® spacer member 700 receives one or more bottom tongues 710 of adjacent spacer members 700 within its own top slot 708, and also receives a side tongue 714 of an adjacent WOODBRICKS® spacer member 700 within its own side slot 712. When this is done, the face plates 706 of horizontally adjacent spacer members 700 will be aligned in rows, and the face plates 706 of vertically adjacent WOODBRICKS® spacer members 700 will be stacked with their side edges offset by any desired amount, i.e., the face plates 706 may be situated directly above each other, or with the horizontal offsets characteristic of bricks in brick walls. Further, the face plates 706 are spaced from each other by valleys 722, as illustrated by the arrayed spacer members illustrated in FIG. 5 (which will be discussed at greater length below).

By using spacer members 700 wherein the top slots 708 are sized and configured substantially identically to the female channel top slots 206 (and the female terminal member top slots 514), and wherein the bottom tongues 710 are sized and configured substantially similar to the male channel bottom tongues 316 (and the male terminal member bottom tongues 410), the spacer members 700 may interfit with the channels and terminal members in the same manner as those structures. FIGS. 3 and 4 illustrate an exemplary slatwall array wherein a single row of spacer members 700 is fit between the male terminal member 400 and the female channel 200, and also between the male channel 300 and the female terminal member 500. If desired, more than one row of spacer members 700 could be used in each of these locations.

Figure 5:
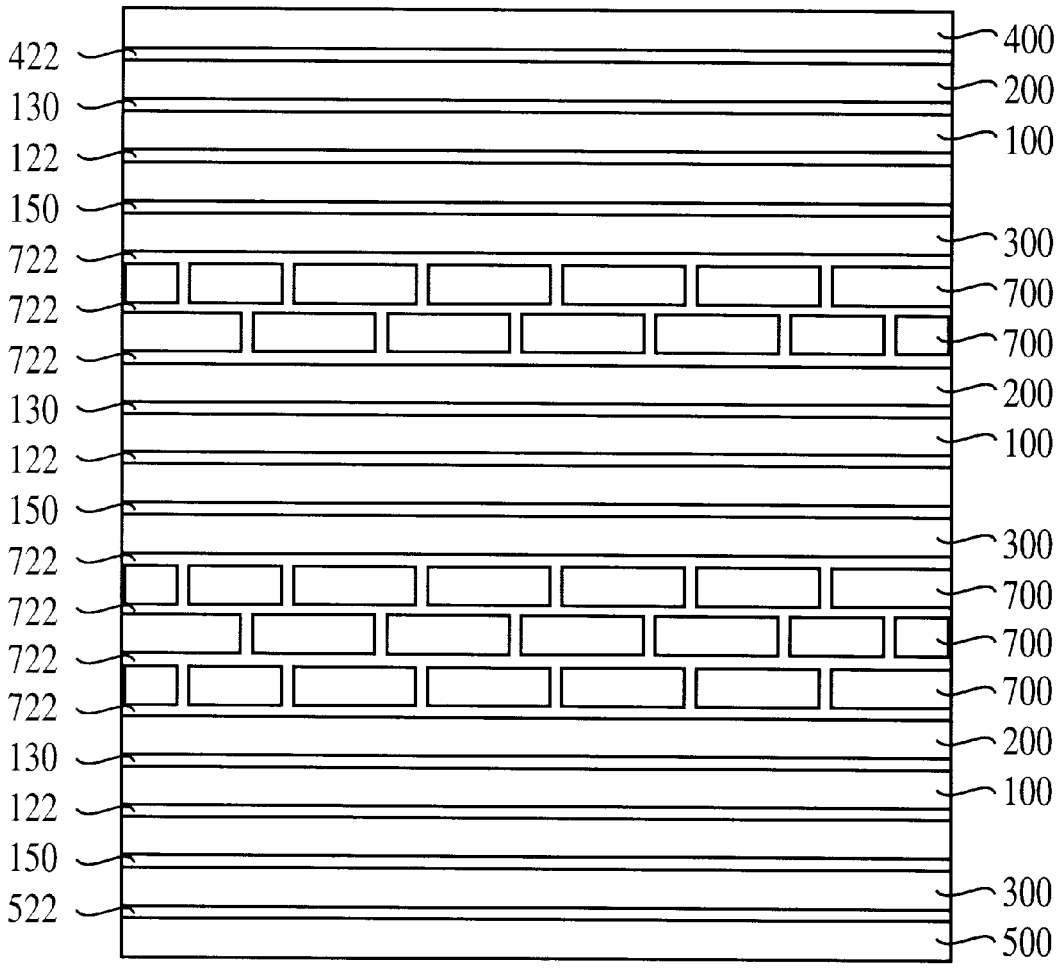
FIG. 5 is a front elevational view of an exemplary slatwall array produced by use of the central channel 100, female channel 200, male channel 300, male terminal member 400, female terminal member 500, and spacer members 700 of FIG. 4.

To illustrate how the aforementioned components may be combined and arranged, FIG. 5 illustrates an exemplary slatwall array produced by use of the central channel 100, female channel 200, male channel 300, male terminal member 400, female terminal member 500, and spacer members 700 of FIGS. 3 and 4 (the channel inserts 600 not being illustrated). Starting from the top of the array, the components are interfit in the following order: the male terminal member 400; the female channel 200; the central channel 100; the male channel 300; two rows of spacer members 700; another female channel 200; another central channel 100; another male channel 300; three rows of spacer members 700; another female channel 200; another central channel 100; another male channel 300; and a female terminal member 500. The various valleys 122, 422, and 522 between the channels and terminal members are difficult to distinguish from the grooves 130, 150 (as are the valleys 722 between the spacer members 700 and the various components noted above). If it is desired to make the appearance of the array more uniform, the WOODBRICKS® spacer members 700 could be replaced with elongated spacer members having approximately the same length as the channels 100, 200, and 300 and terminal members 400 and 500, thereby eliminating the vertically-oriented valleys spaced along the horizontal rows of WOODBRICKS® spacer members 700; alternatively, the channels 100, 200, and 300 and terminal members 400 and 500 may incorporate such vertically-oriented valleys so as to make them more uniform in appearance with respect to the WOODBRICKS® spacer members 700.

It is understood that preferred embodiments of the invention have been described above in order to illustrate how to make and use the invention. The invention is not intended to be limited to these embodiments, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A slatwall system comprising:

a. a central channel including opposing front and rear sides and opposing top and bottom sides,
wherein the top side has a top slot defined therein, and
wherein the bottom side has a bottom slot defined therein, b. a female channel including opposing front and rear sides and opposing top and bottom sides,
wherein the top side has a top slot defined therein, and
wherein the bottom side has a bottom slot defined therein, c. a male channel including opposing front and rear sides and opposing top and bottom sides,
wherein the top side has a top slot defined therein,
wherein the bottom side includes a protruding bottom tongue extending therefrom,
wherein a frontwardly-opening first groove is defined between the front sides of the central and female channels when the female channel bottom side is placed adjacent the central channel top side with the central and female channels having their rear sides situated generally coplanarly, the first groove being defined by the female channel bottom slot and the central channel top slot,
wherein a frontwardly-opening second groove is defined between the front sides of the central and male channels when the male channel top side is placed adjacent the central channel bottom side with the central and male channels having their rear sides situated generally coplanarly, the second groove being defined by the male channel top slot and the central channel bottom slot.

2. A slatwall system comprising:

a. a central channel including opposing front and rear sides and opposing top and bottom sides, wherein:
(1) the top side includes a top front lip adjacent the front side and a top rear lip adjacent the rear side, and a top slot is defined between the top front and rear lips, and
(2) the bottom side includes a bottom front lip adjacent the front side and a bottom rear lip adjacent the rear side, and a bottom slot is defined between the bottom front and rear lips;

b. a female channel including opposing front and rear sides and opposing top and bottom sides, wherein:
(1) the top side includes a top front lip adjacent the front side and a top rear lip adjacent the rear side, and a top slot is defined between the top front and rear lips, and
(2) the bottom side includes a bottom front lip adjacent the front side and a bottom rear lip adjacent the rear side, and a bottom slot is defined between the bottom front and rear lips;

c. a male channel including opposing front and rear sides and opposing top and bottom sides, wherein:
(1) the top side includes a top front lip adjacent the front side and a top rear lip adjacent the rear side, and a top slot is defined between the top front and rear lips, and
(2) the bottom side includes a protruding bottom tongue extending therefrom;
wherein a frontwardly-opening first groove is defined between the front sides of the central and female channels when the female channel bottom side is placed adjacent the central channel top side with the central and female channels having their rear sides situated generally coplanarly, the first groove being defined by the female channel bottom slot and the central channel top slot,
wherein a frontwardly-opening second groove is defined between the front sides of the central and male channels when the male channel top side is placed adjacent the central channel bottom side with the central and male channels having their rear sides situated generally coplanarly, the second groove being defined by the male channel top slot and the central channel bottom slot.

3. The slatwall system of claim 1, 2 wherein at least one of the first and second grooves expands as it extends rearwardly from the front sides of the channels.

4. The slatwall system of claim 1, 2 wherein the bottom tongue of the male channel is adapted to complementarily fit within the top slot of the female channel, with the rear sides of the male and female channels forming a substantially continuous and generally coplanar surface.

5. The slatwall system of claim 1, 2 further comprising:

a male terminal member including opposing front and rear sides and opposing top and bottom sides,
wherein the top side is substantially planar between the front and rear sides, and
wherein the bottom side includes a protruding bottom tongue extending therefrom, b. a female terminal member including opposing front and rear sides and opposing top and bottom sides, wherein the top side has a top slot defined therein, and wherein the bottom side is substantially planar between the front and rear sides, wherein the bottom tongue of the male terminal member is adapted to complementarily fit within the top slot of the female channel, with the rear sides of the male terminal member and female channel forming a substantially continuous and generally coplanar surface, wherein the bottom tongue of the male channel is adapted to complementarily fit within the top slot of the female terminal member, with the rear sides of the male channel and female terminal member forming a substantially continuous and generally coplanar surface.

6. The slatwall system of claim 5:

wherein the bottom tongue of the male terminal member is sized and configured substantially identically to the bottom tongue of the male channel, and wherein the top slot of the female terminal member is sized and configured substantially identically to the top slot of the female channel.

7. The slatwall system of claim 5, further comprising a spacer member including opposing front and rear sides and opposing top and bottom sides, wherein the top side has a top slot defined therein, and wherein the bottom side includes a protruding bottom tongue extending therefrom, and further wherein the bottom tongue of the male terminal member is adapted to complementarily fit within the top slot of the spacer member, with the rear sides of the male terminal member and spacer member forming a substantially continuous and generally coplanar surface, and further wherein the bottom tongue of the spacer member is adapted to complementarily fit within the top slot of the female terminal member, with the rear sides of the spacer member and female terminal member forming a substantially continuous and generally coplanar surface.

8. The slatwall system of claim 7 wherein the central channel includes a central channel valley on its front side, and wherein the male terminal member and female channel define a valley between their front sides when the bottom tongue of the male terminal member is fit within the top slot of the female channel, this valley being sized and configured substantially identically to the central channel valley.

9. The slatwall system of claim 7 wherein the central channel includes a central channel valley on its front side, and wherein the female terminal member and male channel define a valley between their front sides when the bottom tongue of the male channel is fit within the top slot of the female terminal member, this valley being sized and configured substantially identically to the central channel valley.

10. The slatwall system of claim 7 further comprising several adjoining spacer members, wherein each spacer member has at least one of a. its bottom tongue fit within the top slot of one adjoining spacer member, and b. its top slot having the bottom tongue of one adjoining spacer member fit therein.

11. The slatwall system of claim 1, 2 wherein the central channel includes:

a. a top front lip adjacent the front side and a top rear lip adjacent the rear side, wherein the top slot is defined between the top front and rear lips;

b. a bottom front lip adjacent the front side and a bottom rear lip adjacent the rear side, wherein the bottom slot is defined between the bottom front and rear lips, wherein the bottom rear lip has a greater length than the bottom front lip.

12. The slatwall system of claim 11 wherein the female channel includes:

a. a top front lip adjacent the front side and a top rear lip adjacent the rear side, wherein the top slot is defined between the top front and rear lips;

b. a bottom front lip adjacent the front side and a bottom rear lip adjacent the rear side, wherein the bottom slot is defined between the bottom front and rear lips, and wherein the bottom front lip, bottom rear lip, and bottom slot of the female channel are sized and configured substantially identically to the bottom front lip, bottom rear lip, and bottom slot of the central channel.

13. The slatwall system of claim 11 wherein the male channel includes:

a top front lip adjacent the front side and a top rear lip adjacent the rear side, wherein the top slot is defined between the top front and rear lips;

wherein the top front lip, top rear lip, and top slot of the male channel are sized and configured substantially identically to the top front lip, top rear lip, and top slot of the central channel.

14. The slatwall system of claim 1, 2 wherein the female channel includes:

a. a top front lip adjacent the front side and a top rear lip adjacent the rear side, wherein the top slot is defined between the top front and rear lips;

b. a bottom front lip adjacent the front side and a bottom rear lip adjacent the rear side, wherein the bottom slot is defined between the bottom front and rear lips, wherein the bottom rear lip has a greater length than the bottom front lip, and the top rear lip has a greater length than the top front lip.

15. The slatwall system of claim 1, 2 further comprising a concave channel insert adapted to fit within the first groove, the channel insert complementarily fitting within the female channel bottom slot and the central channel top slot.

16. The slatwall system of claim 15 wherein the concave channel insert is also adapted to fit within the second groove, the channel insert complementarily fitting within the male channel top slot and the central channel bottom slot.

17. The slatwall system of claim 1, 2 wherein the female and male channels, when combined in adjoining relationship with the bottom tongue of the male channel received within the top slot of the female channel, are sized and configured substantially identically to the central channel.

18. The slatwall system of claim 1, 2 wherein the bottom tongue of the male channel is adapted to complementarily fit within the top slot of the female channel, with the rear sides of the male channel and female channel forming a substantially continuous and generally coplanar surface.

19. The slatwall system of claim 18 wherein the male and female channels, when fit together in the manner recited by claim 18, are in combination sized and configured substantially identically to the central channel.

* * * * *

UNITED STATES PATENT AND TRADEMARK OFFICE

CERTIFICATE OF CORRECTION

PATENT NO : 6,134,846

DATED : October 24, 2000

INVENTOR(S) : Charles Lamb

It is certified that error appears in the above-identified patent and that said Letters Patent are hereby corrected as shown below:

In claims 3-5, 11, 14, 15, 17, and 18, please strike "1, 2" and insert "1 or 2" in its place.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*